US008226067B1

(12) United States Patent
Jensen

(10) Patent No.: US 8,226,067 B1
(45) Date of Patent: Jul. 24, 2012

(54) SPEAR GUN SUPPORT SYSTEM

(76) Inventor: Johan Holger Jensen, Lakeland, FL (US)

( * ) Notice: Subject to any disclaimer, the term of this patent is extended or adjusted under 35 U.S.C. 154(b) by 125 days.

(21) Appl. No.: 12/802,343

(22) Filed: Jun. 4, 2010

(51) Int. Cl.
*F41C 27/00* (2006.01)

(52) U.S. Cl. ..... 248/671; 211/60.1; 42/106

(58) Field of Classification Search ..... 248/671, 248/74.1, 62, 65, 68.1, 49; 211/60.1, 64, 211/13.1; 42/90, 106
See application file for complete search history.

(56) References Cited

U.S. PATENT DOCUMENTS 4,488,696 A * 12/1984 Sauber ..... 248/74.4
4,804,158 A * 2/1989 Collins et al. ..... 248/74.4
6,431,502 B1 * 8/2002 Goodman ..... 248/74.1
7,290,805 B2 * 11/2007 Wu ..... 285/365
7,341,245 B2 * 3/2008 Joseph ..... 267/141
7,849,630 B2 * 12/2010 Carnevali ..... 43/21.2
2008/0283687 A1 * 11/2008 McClure et al. ..... 248/74.1
2009/0127407 A1 * 5/2009 Pothanikat et al. ..... 248/74.1

* cited by examiner

*Primary Examiner* — Anita M King
*Assistant Examiner* — Steven Marsh

(57) ABSTRACT

A cradle has upper and lower surfaces, a periphery and opposed first and second ends. A closed projection extends upwardly from the first end with spaced parallel faces and co-axial bores. Laterally spaced open projections extend upwardly from the second end. Each open projection has a free exterior with a recess extending inwardly. A draw latch fabricated of an elastomer has a handle and a major portion. The major portion has a fixed end positioned between the parallel faces of the closed projection. The fixed end has a central bore. A pivot pin extends through the central and co-axial bores. The major portion has a movable end with an enlargement. The draw latch is adapted to be unstretched whereby the enlargement is located between the recesses.

2 Claims, 8 Drawing Sheets

SPEAR GUN SUPPORT SYSTEM

BACKGROUND OF THE INVENTION

1. Field of the Invention

The present invention relates to a spear gun support system and more particularly pertains to removably retaining spear guns in a preferred location on a boat or otherwise in a safe, convenient and economical manner.

2. Description of the Prior Art

The use of spear gun support systems of known designs and configurations is known in the prior art. More specifically, spear gun support systems of known designs and configurations previously devised and utilized for the purpose of retaining spear guns are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a spear gun support system that allows removably retaining spear guns in a preferred location on a boat or otherwise in a safe, convenient and economical manner.

In this respect, the spear gun support system according to the present invention substantially departs from the conventional concepts and designs of the prior art, and in doing so provides an apparatus primarily developed for the purpose of removably retaining spear guns in a preferred location on a boat or otherwise in anticipation of use in a safe, convenient and economical manner.

Therefore, it can be appreciated that there exists a continuing need for a new and improved spear gun support system which can be used for removably retaining spear guns in a preferred location on a boat or otherwise in anticipation of use in a safe, convenient and economical manner. In this regard, the present invention substantially fulfills this need.

SUMMARY OF THE INVENTION

In view of the foregoing disadvantages inherent in the known types of spear gun support systems of known designs and configurations now present in the prior art, the present invention provides an improved spear gun support system. As such, the general purpose of the present invention, which will be described subsequently in greater detail, is to provide a new and improved spear gun support system and method which has all the advantages of the prior art and none of the disadvantages.

To attain this, the present invention essentially comprises The spear gun support system of the present invention is for removably retaining spear guns in a preferred location on a boat or otherwise in anticipation of use. The removably retaining is done in a safe, convenient and economical manner. First provided is a cradle. The cradle has an upper surface and a parallel lower surface. The cradle has an oval periphery between the upper and lower surfaces, a central aperture and opposed first and second ends. Small recesses are formed in the lower surface in a circular configuration around the central aperture. A closed projection extends upwardly from the upper surface at the first end. The closed projection has spaced parallel faces with co-axial bores. Laterally spaced open projections extend upwardly from the upper surface at the second end. Each open projection has a free exterior end with a hemispherical recess extending inwardly a fixed distance from the exterior end. Laterally spaced central projections extend upwardly from the upper surface midway between the first and second ends. All of the projections have a common height to form two similarly configured spear gun-receiving chambers on opposite sides of the central projections. The cradle is fabricated of machined aluminum.

Next, a draw latch fabricated of EPDM rubber is provided. The draw latch has a minor portion functioning as a handle. The draw latch also has a major portion in a generally rectilinear configuration with an upper face and a parallel lower face. The major portion has a fixed end and an opposed movable end. The fixed end is positioned between the parallel faces of the closed projection. The fixed end has a central bore coextensive with the co-axial bores. A pivot pin extends through the central and co-axial bores for pivotally coupling the draw latch to the cradle. The movable end has a generally spherical enlargement. The draw latch is adapted to be stretched whereby the enlargement is exterior of the open projections to allow pivoting of the draw latch. The draw latch adapted to be unstretched whereby the enlargement is located between the hemispherical recesses to lock the draw latch with respect to the cradle. The draw latch has a downward extension. The downward extension is positionable between the central projections to fully separate the two chambers. Three strips of an elastomeric material extend upwardly from the upper surface of the cradle in each chamber whereby spear guns within the chambers will be out of contact with machined aluminum.

Next, a tubing mount is provided. The tubing mount is formed of an exterior portion and an interior portion. Each portion has a semicircular part, wings with apertures, and an annular recess. Threaded fasteners separably couple the exterior portion and interior portion of the tubing mount. A flat surface is provided on the exterior portion. The flat surface is positionable on the lower surface of the cradle. The flat surface has two laterally spaced pegs selectively positionable in two of the small recesses that are diametrically opposed. This allows for varying the angular orientation of the cradle with respect to the tubing mount. The tubing mount is fabricated of machined aluminum.

Lastly, an elastomeric semicircular spacer is provided in the recess of each semicircular part of the tubing mount. The spacers have a common external diameter corresponding to the diameter of the annular recesses of the tubing mount. The internal diameter of the spacers is determined by the size of the tubing used to support the tubing mount with associated cradle. In the preferred embodiment two tubing mounts and cradles are employed which are axially spaced.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved spear gun support system which has all of the advantages of the prior art spear gun support systems of known designs and configurations and none of the disadvantages.

It is another object of the present invention to provide a new and improved spear gun support system which may be easily and efficiently manufactured and marketed.

It is further object of the present invention to provide a new and improved spear gun support system which is of durable and reliable constructions.

An even further object of the present invention is to provide a new and improved spear gun support system which is susceptible of a low cost of manufacture with regard to both materials and labor, and which accordingly is then susceptible of low prices of sale to the consuming public, thereby making such spear gun support system economically available to the buying public.

Even still another object of the present invention is to provide a spear gun support system for removably retaining spear guns in a preferred location on a boat or otherwise in anticipation of use in a safe, convenient and economical manner.

Lastly, it is an object of the present invention to provide a new and improved spear gun system having a cradle. A closed projection extends upwardly from the first end of the cradle and has spaced parallel faces and co-axial bores. Laterally spaced open projections extend upwardly from the second end of the cradle. Each open projection has a free exterior with a recess extending inwardly. A draw latch fabricated of an elastomer has a handle and a major portion. The major portion has a fixed end positioned between the parallel faces of the closed projection. The fixed end has a central bore. A pivot pin extends through the central and co-axial bores. The major portion has a movable end with an enlargement. The draw latch is adapted to be unstretched whereby the enlargement is located between the recesses.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
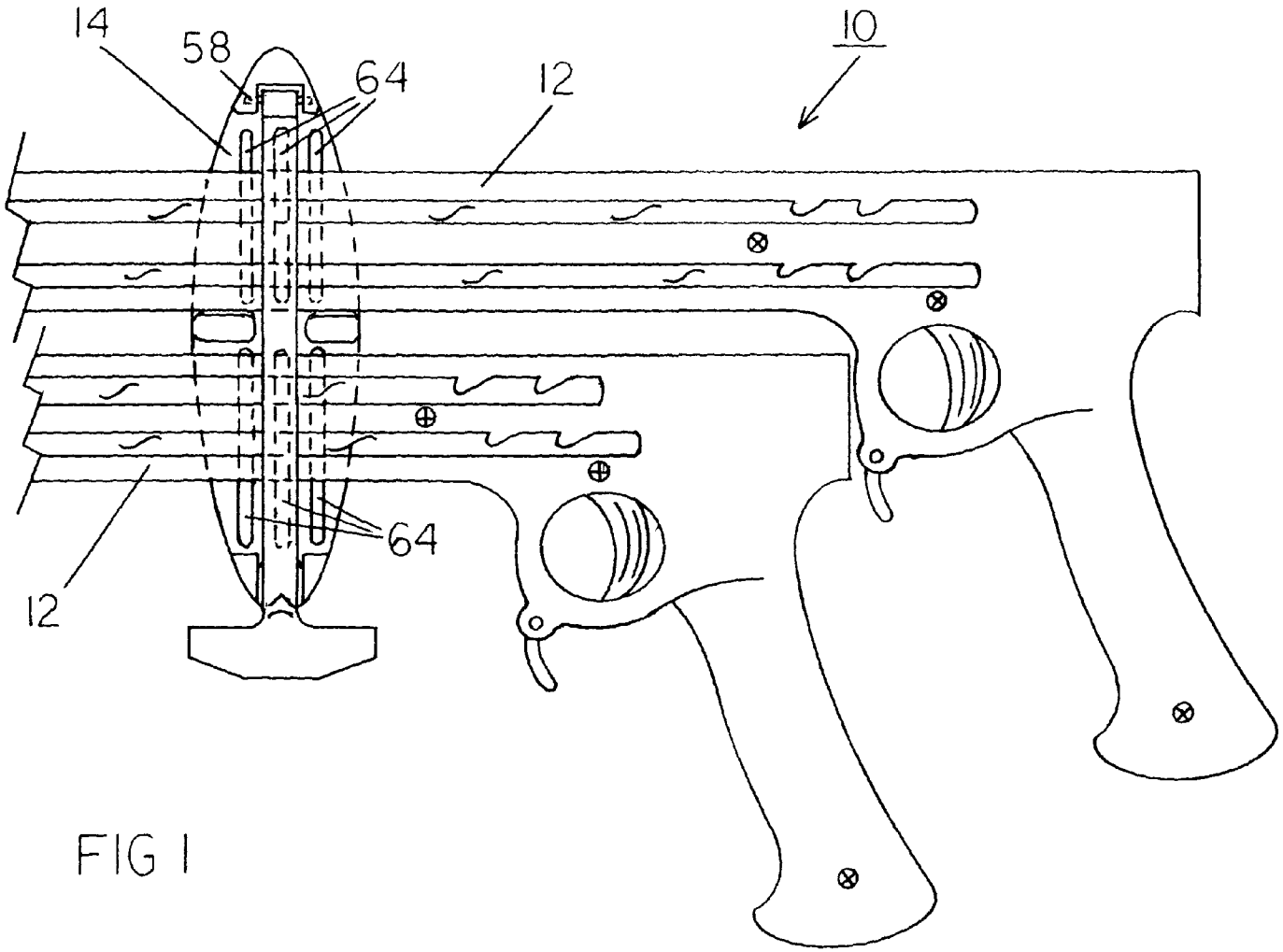
FIG. 1 is a front elevational view of a spear gun support system constructed in accordance with the principles of the present invention, the system being shown in operation and use retaining two spear guns.
Figure 2:
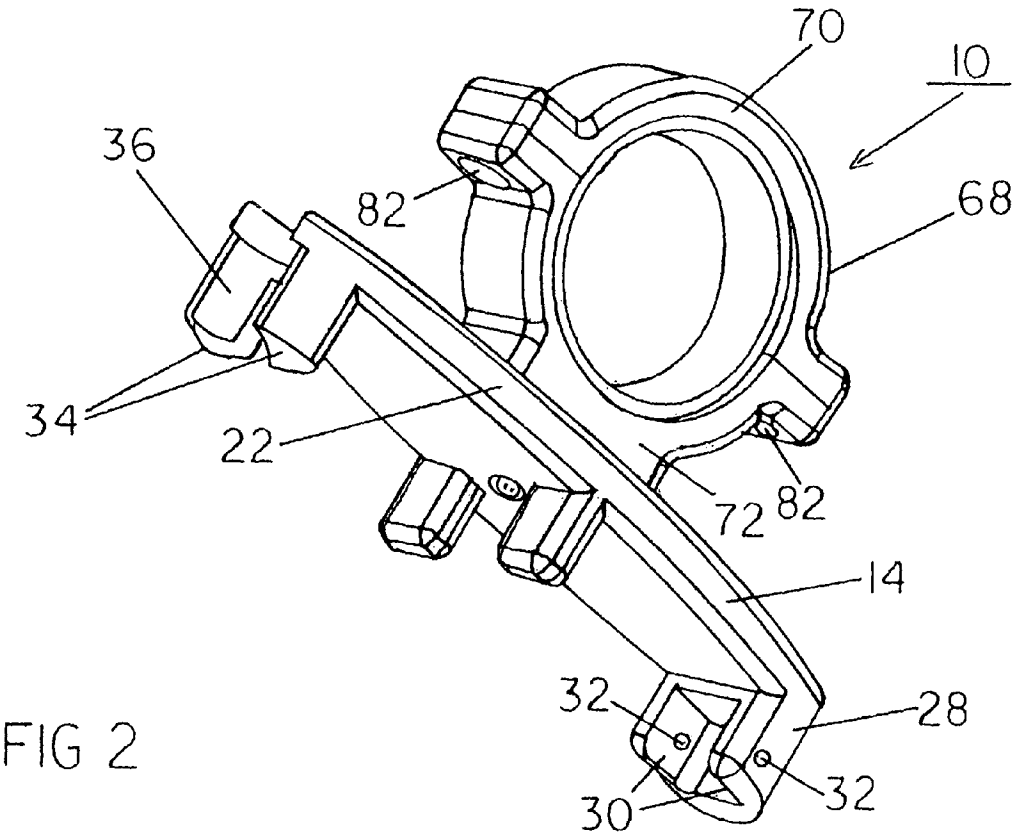
FIG. 2 is a perspective illustration of the support system of the present invention with the draw latch removed.
Figure 3:
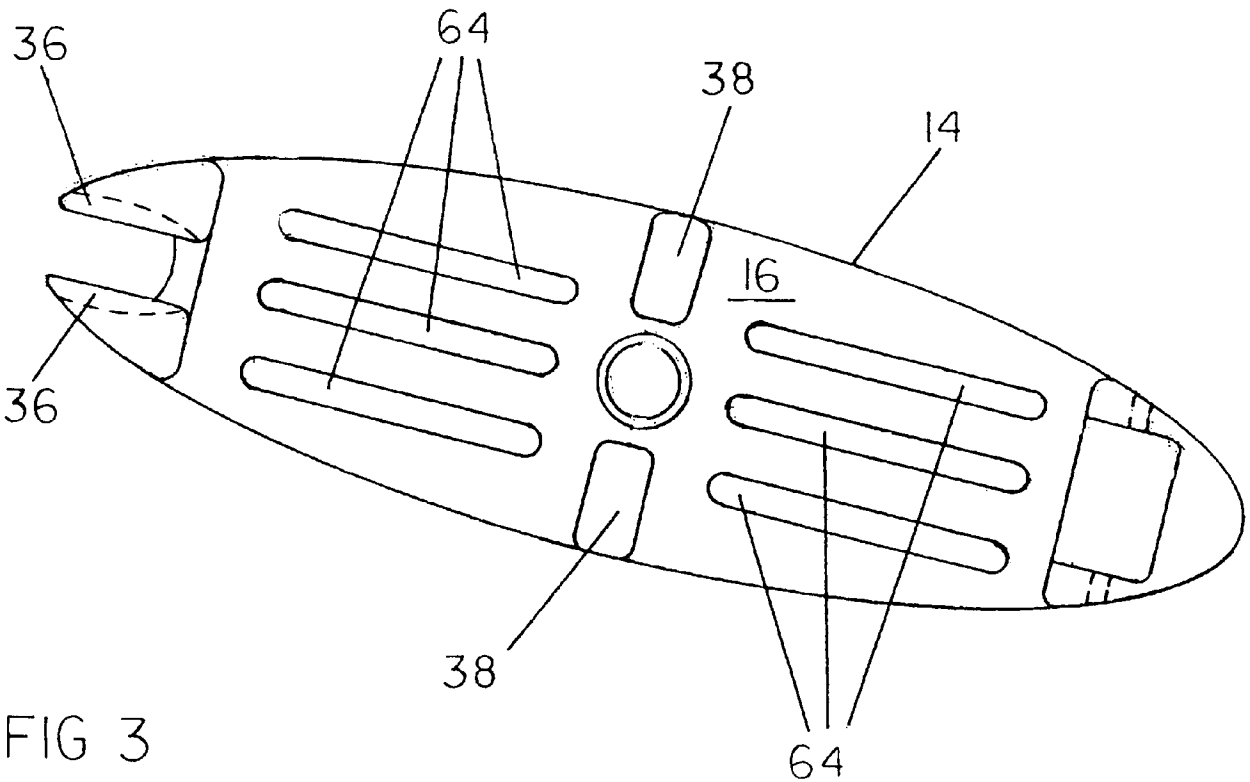
FIG. 3 is a front elevation view of the cradle of the present invention.
Figure 4:
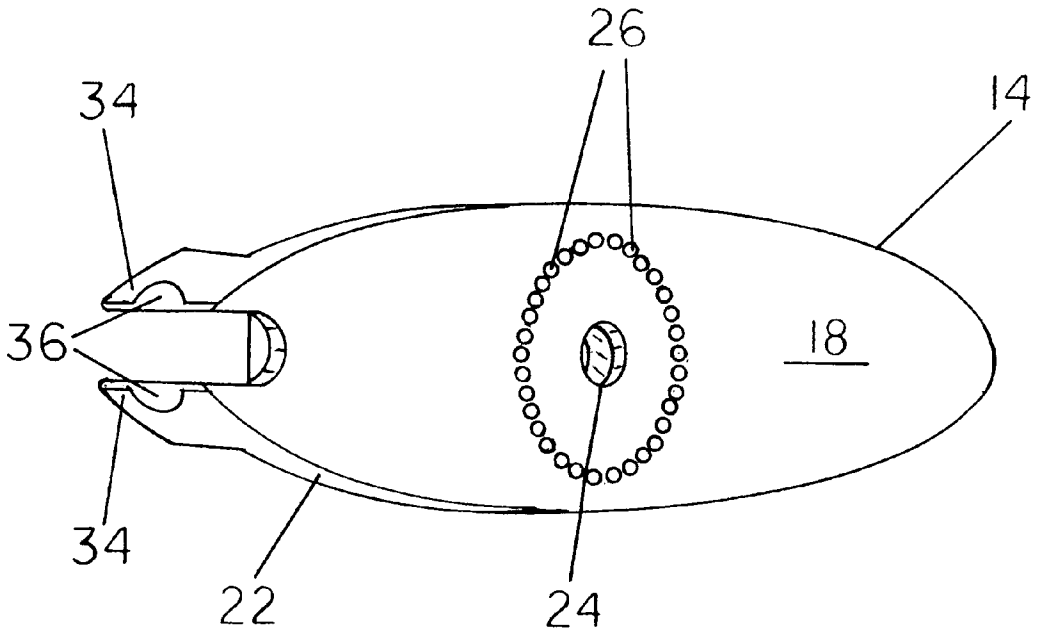
FIG. 4 is rear elevational view of the cradle.
Figure 5:
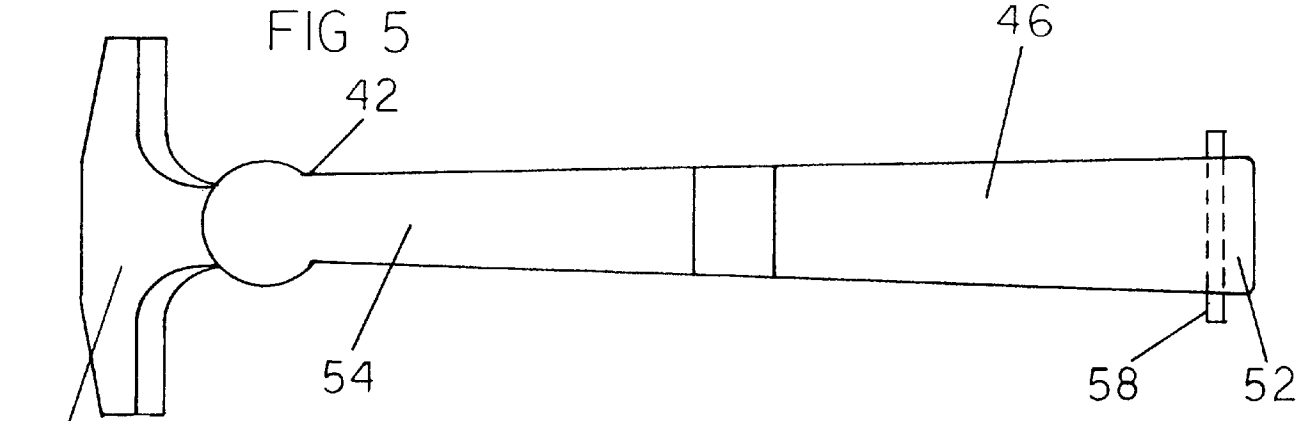
FIG. 5 is a plan view of the draw latch of the present invention.
Figure 6:
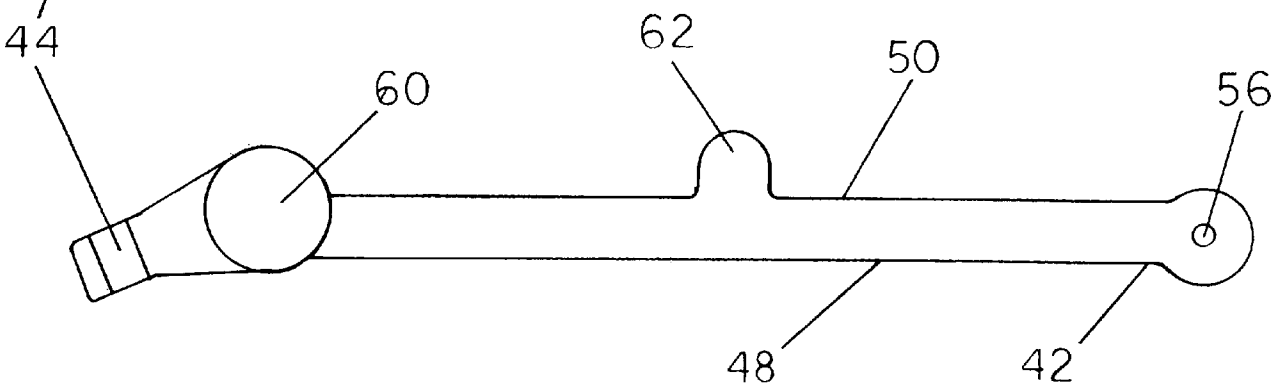
FIG. 6 is a side elevational view of the draw latch.
Figure 7:
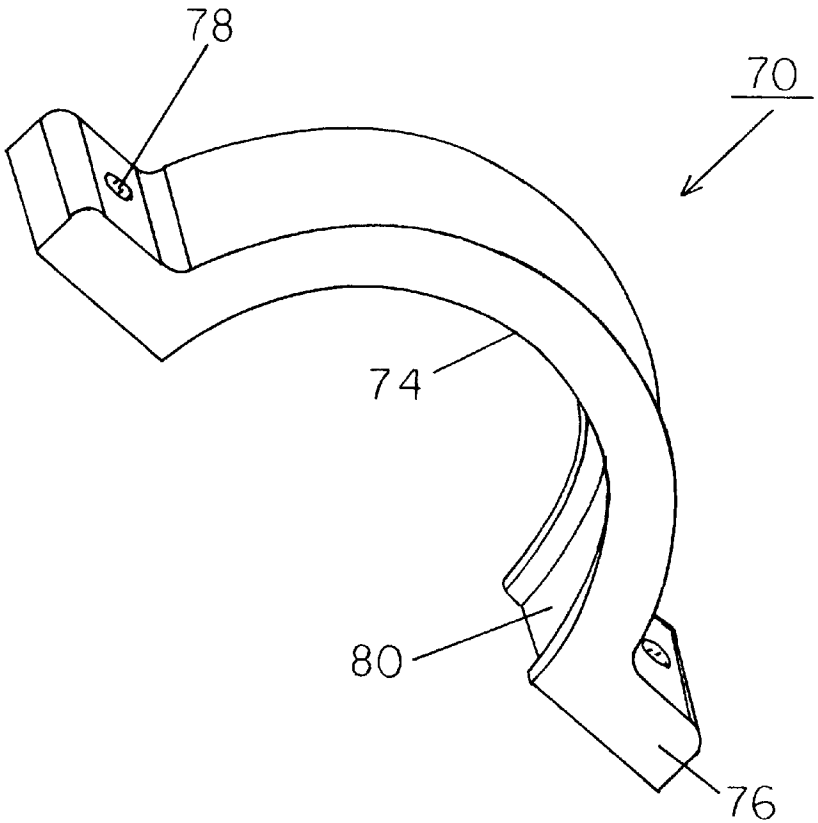
FIG. 7 is a perspective illustration of the exterior portion of the tubing mount.
Figure 8:
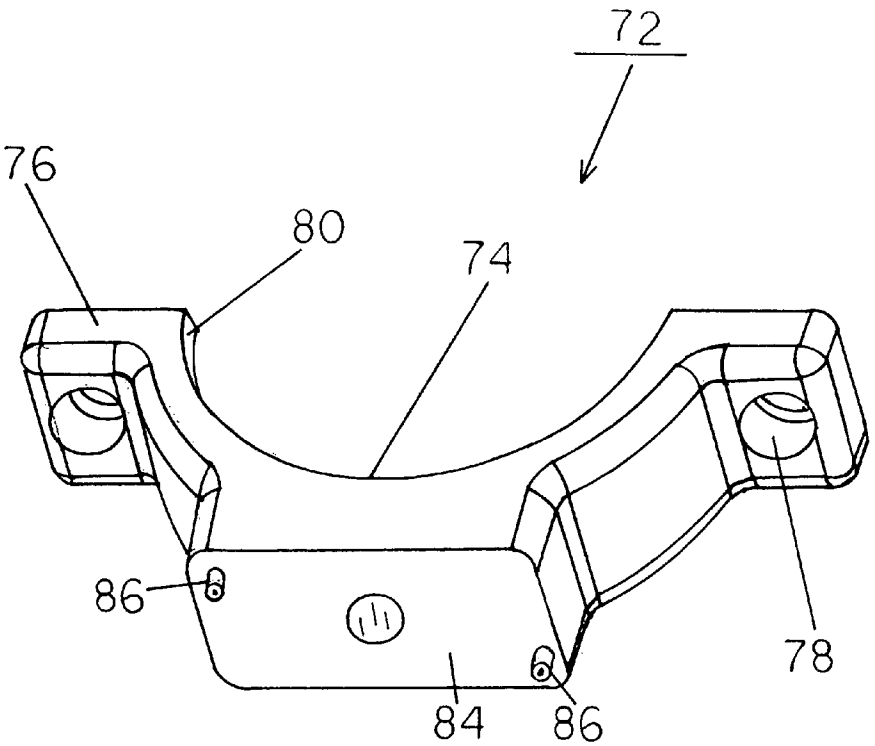
FIG. 8 is a perspective illustration of the interior portion of the tubing mount.
Figure 9:
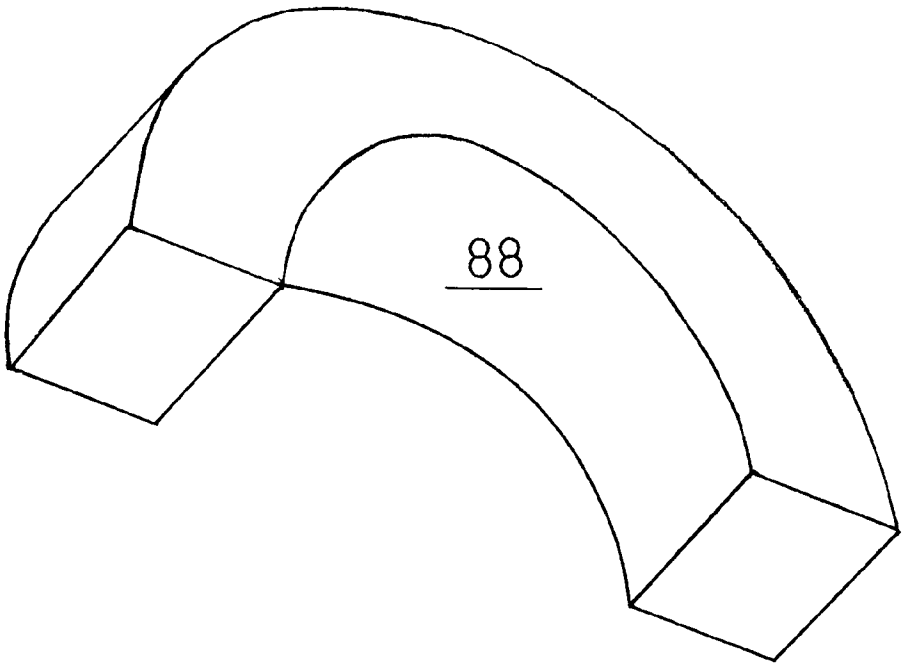
FIG. 9 is a perspective illustration of the spacer.

With reference now to the drawings, and in particular to FIG. 1 thereof, the preferred embodiment of the new and improved spear gun support system embodying the principles and concepts of the present invention and generally designated by the reference numeral 10 will be described.

The present invention, the spear gun support system 10 is comprised of a plurality of components. Such components in their broadest context include a cradle and a draw latch. Such components are individually configured and correlated with respect to each other so as to attain the desired objective.

The spear gun support system 10 of the present invention is for removably retaining spear guns 12 in a preferred location on a boat or otherwise in anticipation of use. The retaining and removing is done in a safe, convenient and economical manner.

First provided is a cradle 14. The cradle has an upper surface 16 and a parallel lower surface 18. The cradle has an oval periphery 22 between the upper and lower surfaces, a central aperture 24 and opposed first and second ends 36. Small recesses 26 are formed in the lower surface in a circular configuration around the central aperture. A closed projection 28 extends upwardly from the upper surface at the first end. The closed projection has spaced parallel faces 30 with co-axial bores 32. Laterally spaced open projections 34 extend upwardly from the upper surface at the second end. Each open projection has a free exterior end with a hemispherical recess 36 extending inwardly a fixed distance from the exterior end. Laterally spaced central projections 38 extend upwardly from the upper surface midway between the first and second ends. All of the projections have a common height to form two similarly configured spear gun-receiving chambers on opposite sides of the central projections. The cradle is fabricated of machined aluminum or other suitable rigid durable material.

Next, a draw latch 42 fabricated of EPDM rubber is provided. The draw latch has a minor portion 44 functioning as a handle. The draw latch also has a major portion 46 in a generally rectilinear configuration with an upper face 48 and a parallel lower face 50. The major portion has a fixed end 52 and an opposed movable end 54. The fixed end is positioned between the parallel faces of the closed projection. The fixed end has a central bore 56 coextensive with the co-axial bores. A pivot pin 58 extends through the central and co-axial bores for pivotally coupling the draw latch to the cradle. The movable end has a generally spherical enlargement 60. The draw latch is adapted to be stretched whereby the enlargement is exterior of the open projections to allow pivoting of the draw latch. The draw latch adapted to be unstretched whereby the enlargement is located between the hemispherical recesses to lock the draw latch with respect to the cradle. The draw latch has a downward extension 62. The downward extension is positionable between the central projections to fully separate the two chambers. Three strips 64 of an elastomeric material extend upwardly from the upper surface of the cradle in each chamber. In this manner, the spear guns are securely retained without contacting the machined aluminum thereby avoiding the possibility of marring of the spear guns.

Next, a tubing mount 68 is provided. The tubing mount is formed of an exterior portion 70 and an interior portion 72. Each portion has a semicircular part 74, wings 76 with apertures 78, and an annular recess 80. Threaded fasteners 82 separably couple the exterior portion and interior portion of the tubing mount. A flat surface 84 is provided on the exterior portion. The flat surface is positionable on the lower surface of the cradle. The flat surface has two laterally spaced pegs 86 selectively positionable in two of the small recesses 26 that are diametrically opposed. This allows for varying the angular orientation of the cradle with respect to the tubing mount. The tubing mount is fabricated of machined aluminum or other suitable rigid durable material.

Lastly, an elastomeric semicircular spacer 88 is provided in the recess of each semicircular part of the tubing mount. The spacers have a common external diameter corresponding to the diameter of the annular recesses of the tubing mount. The internal diameter of the spacers is determined by the size of the tubing used to support the tubing mount with associated cradle. In the preferred embodiment two tubing mounts with axially spaced cradles are employed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A spear gun support system comprising:

a cradle having upper and lower surfaces, the cradle having a periphery and opposed first and second ends, a closed projection extending upwardly from the first end, the closed projection having spaced parallel faces and co-axial bores, laterally spaced open projections extending upwardly from the second end, each open projection having a free exterior with a recess extending inwardly; and a draw latch fabricated of an elastomer and having a handle and a major portion, the major portion having a fixed end with a central bore, the major portion positioned between the parallel faces of the closed projection, a pivot pin extending through the central and co-axial bores, the major portion having a movable end with an enlargement, the draw latch adapted to be unstretched whereby the enlargement is located between the recesses.

2. The system as set forth in claim 1 and further including:

a tubing mount formed of exterior and interior portions, each portion having a semicircular part and laterally spaced wings with apertures, each semicircular part being formed with an annular recess, threaded fasteners separably coupling the exterior portion and interior portion of the tubing mount, a flat surface on the exterior portion positionable on and secured to the lower surface of the cradle.

* * * * *